US006244430B1

(12) United States Patent
Travis

(10) Patent No.: US 6,244,430 B1
(45) Date of Patent: Jun. 12, 2001

(54) EASILY TRANSPORTED CONTACT LENS CARE KIT

(76) Inventor: Aaron T. Travis, 559 Locust SE., E. Grand Rapids, MI (US) 49506

( * ) Notice: Subject to any disclaimer, the term of this patent is extended or adjusted under 35 U.S.C. 154(b) by 0 days.

(21) Appl. No.: 09/178,959

(22) Filed: Oct. 26, 1998

(51) Int. Cl.[7] ..... A45C 11/04

(52) U.S. Cl. ..... 206/5.1; 206/205

(58) Field of Search ..... 206/5, 5.1, 223, 206/37.1, 37.5, 37.8, 38, 38.1, 205, 525, 528; 24/3.6, 3.8; 70/429, 430; 134/901; 220/23.91, 495.06; D3/208, 264

(56) References Cited

U.S. PATENT DOCUMENTS

| | | | | |
|---|---|---|---|---|
| D. 196,681 | | 10/1963 | Middleton . | |
| D. 388,602 | | 1/1998 | Petruzzi . | |
| D. 393,148 | | 4/1998 | Petruzzi . | |
| 3,780,918 | | 12/1973 | Curtis . | |
| 3,918,503 | | 11/1975 | Bundy . | |
| 3,955,726 | | 5/1976 | Reitzel . | |
| 4,691,725 | * | 9/1987 | Parisi | 206/5.1 |
| 4,691,820 | * | 9/1987 | Martinez | 206/5.1 |
| 5,002,179 | | 3/1991 | Dhalla . | |
| 5,375,699 | | 12/1994 | Amend . | |
| 5,409,104 | * | 4/1995 | Lovell | 206/5.1 |
| 5,538,301 | * | 7/1996 | Yavitz et al. | 206/5.1 |
| 5,676,243 | | 10/1997 | Sanders . | |
| 5,685,420 | * | 11/1997 | Martin et al. | 206/5.1 |
| 5,711,416 | | 1/1998 | Bauman . | |
| 5,713,460 | * | 2/1998 | Evans et al. | 206/5.1 |
| 5,993,755 | * | 11/1999 | Andersen | 206/5.1 |

* cited by examiner

*Primary Examiner*—Luan K. Bui
(74) *Attorney, Agent, or Firm*—Young & Basile, P.C.

(57) ABSTRACT

A portable contact lens and fluid storage kit comprising a generally conventional lens case adapted to receive a quick-detachable key ring attachment device so that the case may be carried with a set of keys in a convenient and hard to forget fashion. The key chain attachment device is easily detached so that the case may be separated from the keys and rested on a flat surface during contact lens insertion and removal. In a further form, the invention comprises removable, sealed fluid inserts adapted to nest inside the lens-holding cups of the lens case, containing enough contact lens treating fluid to fill their respective cups.

10 Claims, 4 Drawing Sheets

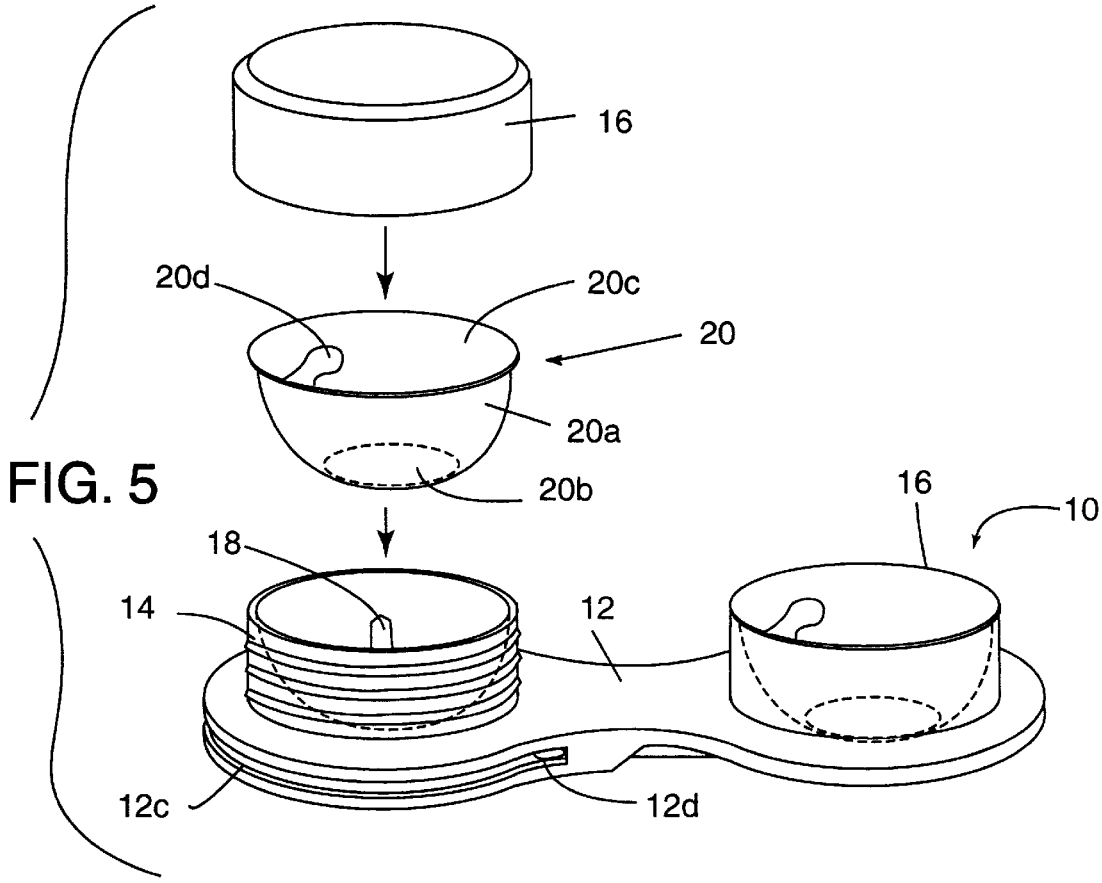
FIG. 5
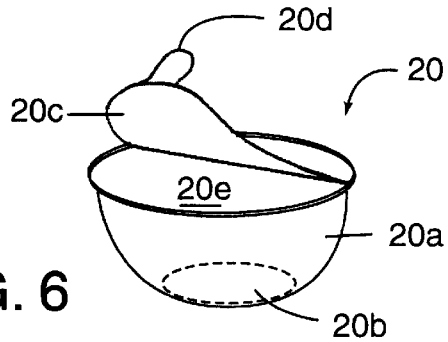
FIG. 6
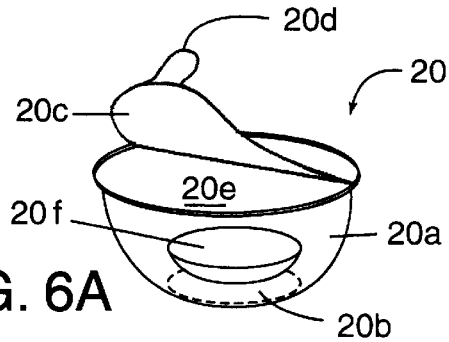
FIG. 6A
FIG. 7
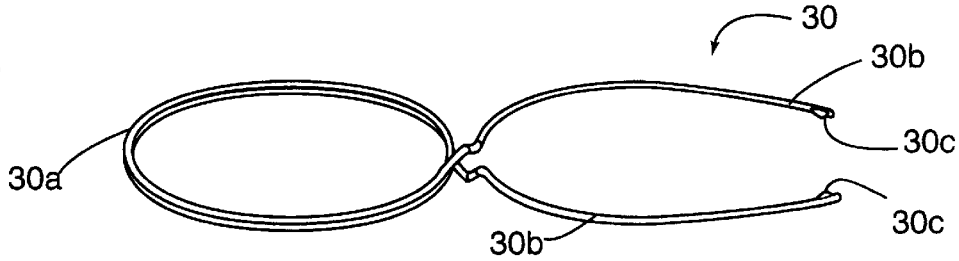

EASILY TRANSPORTED CONTACT LENS CARE KIT

FIELD OF THE INVENTION

This invention is in the field of contact lens storage cases.

BACKGROUND OF THE INVENTION

People who use contact lenses, whether of the rigid or soft variety, always need something handy in which to store them. The reasons vary: unexpected overnight stays away from home; travel; activities where there is a need or likelihood for frequent contact lens removal and replacement. This storage device must hold fluid to keep the lenses lubricated and must be sealed so as not to allow bacteria to enter. Without fluid the lenses can become damaged or destroyed.

Quite often, a contact lens wearer will get a foreign object in the eye (e.g., an eyelash or dirt particle) that causes irritation. In such cases, the contact lens must be removed from the eye and cleaned, and then re-inserted into the eye or stored in suitable fluid. Should this type of minor emergency happen when a contact lens case is not readily available, a frantic search begins for some sort of alternate moist storage container, such as a cup of water. However, this is not a sanitary solution on either a short or long term basis. Another known solution for such emergency storage is to lubricate the lens with saliva after taking it out, and then to re-insert it into the eye. This is probably the worst solution, as saliva is acidic and damaging to the eye.

While most contact lens storage devices are relatively small and easy transportable, their necessity is often forgotten until an emergency arises. There is currently no simple, effective way to ensure that a case will always be available. Some keep extra cases in their glove compartments. Some carry cases in purses or backpacks. However, despite their efforts, contact lens wearers still frequently find themselves without their contact lens cases.

A few portable lens case devices do exist for facilitating storage of the case on one's person. U.S. Pat. No. 3,955,726 shows a pendant for storing contact lenses, hung from a chain around the neck. U.S. Pat. No. 3,780,918 discloses a wristwatch capable of storing contact lenses. U.S. Pat. No. 5,002,179 shows a fluid-storing lens case resembling a pen.

Yet even with such known portable lens cases, having a contact lens case alone is not a complete solution to the aforementioned problem of temporary or emergency lens storage. Most contact lenses require special fluids for cleaning, disinfecting and storing them. The bottles containing these fluids are much larger than lens cases, and therefore reduce the portability of any complete lens care kit. To resolve this, some people are known to keep soaking solution in the lens compartments of a standard lens case. Unfortunately, the stored fluid tends to leak out if the top of the case is not closed tightly enough, and ultimately evaporates. Additionally, if the fluid-filled case leaks, bacteria has the ability to get inside and contaminate the fluid in which the contact lenses will eventually be stored. Attempts have been made to solve the fluid storage problem. U.S. Pat. No. 5,375,699 shows a contact lens case with a rubber 'O'-ring around the rim of the storage area to prevent leakage of fluid stored in the lens compartments. U.S. Pat. No. 5,711,416 shows a disposable contact lens storage unit with a sealed top to prevent air or fluid from entering or escaping.

SUMMARY OF THE INVENTION

The present invention solves the foregoing problems in two complementary ways. First, a conventional lens case is provided with a quick-detachable key ring or key chain attachment releasably locked to a specially formed horizontal portion of the lens case. For example, conventional lens cases generally comprise two cylindrical, cap-sealed cups located on either end of a relatively flat, horizontal, web portion. In the present invention, one or more portions of the cup-connecting web is provided with a groove or recess adapted to lockingly receive matingly contoured spring lock arms of the key ring attachment. In a preferred form the recess for the lock arms is formed in the edge of the horizontal web, such that the key ring attachment is mated with the lens case in a horizontal, parallel plane which allows the case to be rested on a flat surface.

In a further preferred form the key ring attachment device is formed from a single piece of spring wire, with a closed loop on one end for attachment to a key chain, and two integral, opposed spring lock arms with a contour and spacing adapted to snap over and around the portion of the lens case web in a friction fit, preferably further enhanced by the recessing of the lock arms into the groove in the edge of the web, and even further by knobs or tabs on the end of the lock arm which mate with detents in the groove.

The key ring attachment remains securely locked to the case until its spring lock arms are forced apart, allowing the case to be quickly and easily separated from the key chain so that it can be laid flat on a narrow surface such as the edge of a sink.

With the portability and availability of the lens storage case itself solved by the key ring attachment feature above, the fluid storage problem is solved by way of novel fluid-holding cup inserts which fit precisely into the lens cups in the lens case. The fluid-holding inserts of the present invention comprise in one preferred form disposable plastic blisters or bubbles of sterile, sealed lens fluid with removable plastic or foil tops. The inserts drop into the lens cups and are secured with the standard lens cup caps without the need for external sealing structure on the case such as lens cup O-rings. The fluid inserts are designed to hold just enough fluid to fill their respective lens cups and still allow a contact lens to be placed in the fluid inside the cup for storage, soaking or cleaning.

In the event that a contact lens needs to be removed from the eye and temporarily stored or cleaned in the case, the user simply unscrews the cap from a lens cup, removes the fluid insert, peels back its top, pours the fluid back into the lens cup, and places the contact lens in the now fluid-filled cup until ready for use.

These and other features of the present invention will be better understood upon reading the following specification with reference to the drawings.

BRIEF DESCRIPTION OF THE DRAWINGS

FIG. 5 is a side perspective view of the lens case of FIG. 1, with an exploded representation of one of the lens cups, a removable fluid insert according to the invention, and the lens cup cap;

FIG. 6 is a side perspective view of a fluid insert according to the present invention, illustrating a disposable type with a peelaway cover partly removed;

FIG. 6A illustrates the fluid insert of FIG. 6 with an optional disposable contact lens stored therein;

FIG. 7 is a perspective view of a key ring attachment according to the invention, adapted to removably lock onto the lens case of FIG. 1;

DETAILED DESCRIPTION OF THE ILLUSTRATED EMBODIMENTS

Figure 1:
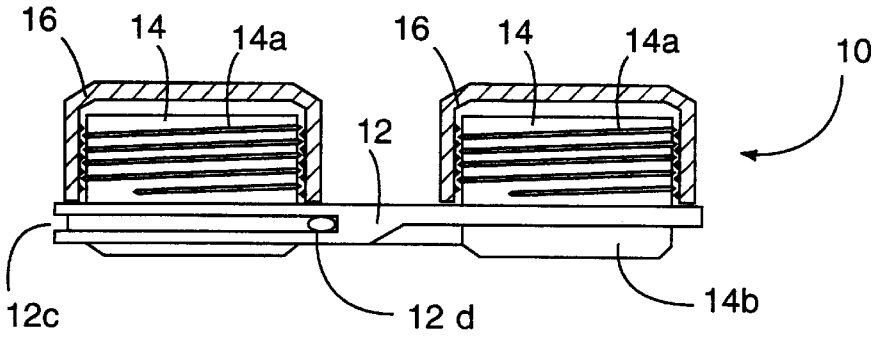
FIG. 1 is an elevated side view of a lens case according to the present invention, with lens cup caps sectioned for clarity.

Referring first to FIGS. 1–4, a preferred example of a lens case 10 according to the present invention comprises a flat, horizontal web portion 12, and two spaced cylindrical cups 14 adapted to each hold a contact lens, the cups 14 having external threads 14*a* for receiving threaded caps 16. Lens case 10 is preferably integrally molded from a suitable plastic material, as is common in the art, although other known materials and methods of manufacture could be used.

In the illustrated lens case example, web portion 12 is somewhat "8" or "dog bone" shaped, in that it has rounded, circular ends 12*a* containing cups 14, and a curved, narrowed middle region 12*b*. So far the structure described for lens case 10, including the shape of web 12, is conventional. It will be understood by those skilled in the art that other styles of lens case are commercially available, and that the invention is adaptable to different types of lens cases with only minor modifications.

In accordance with the present invention, at least one of the rounded ends 12*a* of web 12 is provided with a peripheral locking groove 12*c* extending at least partway into the narrowed middle region 12*b* of the web. In the illustrated embodiment, locking groove 12*c* is recessed into the web and terminates on either side of the web in detent holes 12*d* for a purpose described below.

Figure 2:
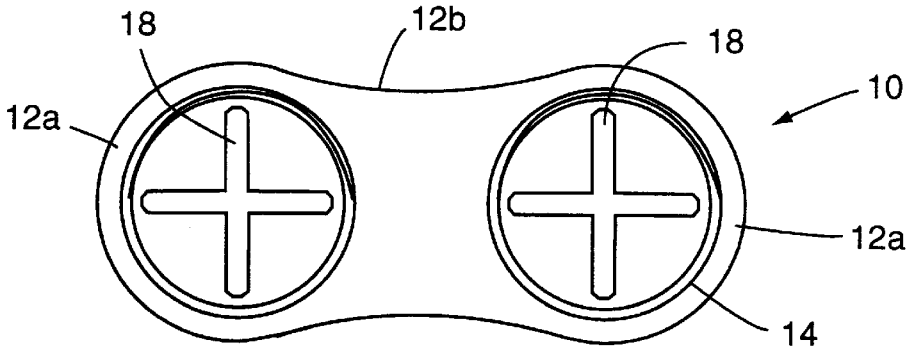
FIG. 2 is a plan view of the lens case of FIG. 1 with the caps removed.

Referring to FIG. 2, cups 14 are provided with cruciform slots 18 formed in the bottom surface of each cup to prevent the contact lenses from sticking to the bottom surface of a moistened cup by capillary suction. Slots 18 are generally known in the art.

Figure 3:
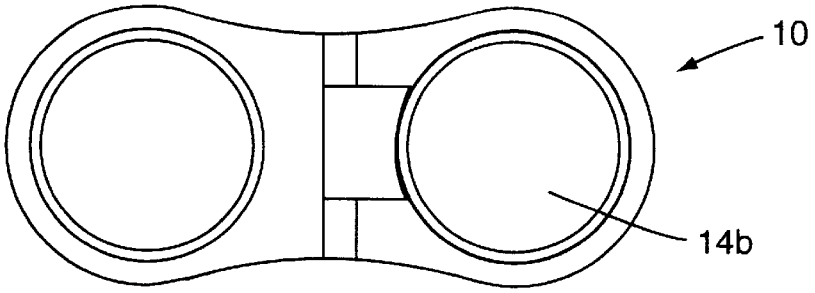
FIG. 3 is a bottom plan view of the lens case of FIG. 1.

Referring to FIG. 3, in the illustrated embodiment only one end of web 12 is provided with a locking groove 12*c*, while the opposite end of the web has a reduced thickness which allows the lower portion 14*b* of its respective cup 14 to be grasped by the fingers and pulled for a purpose described below. Of course, it is possible to construct lens case 10 according to the invention with a locking groove 12*c* in both ends, but for simplicity of illustration herein, a version of lens case 10 with a single locking groove 12*c* is shown and described.

Figure 4:
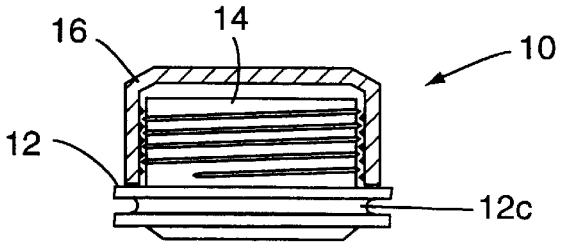
FIG. 4 is an end elevational view of a key ring attachment end of the lens case of FIG. 1.

FIG. 4 clearly shows the recessed nature of locking groove 12*c*, such that upper and lower portions of web 12 overhang the groove.

Referring next to FIGS. 5 and 6, lens case 10 is shown provided with novel fluid inserts 20 shaped to fit snugly within cups 14 and to be contained therein by caps 16. Fluid inserts 20 preferably comprise disposable plastic bubbles or blisters 20*a* containing a small amount of known contact cleaning or storage solution 20*e* sufficient to fill one of cups 14 to a desired level. Fluid inserts 20 are sealed, in the illustrated disposable embodiment by a peelaway cover 20*c* comprising a known type of paper, plastic or foil secured in fluidtight and airtight fashion to the upper edge of plastic blister 20*a*. Cover 20*c* in the illustrated embodiment is provided with a peelaway actuator tab 20*d* of known type.

Fluid inserts 20 are generally cup- or bowl-shaped to fit in cups 14, and further preferably have flat bottoms 20*b* to allow them to stand on a flat, even surface (such as a sink or countertop) without tipping.

It will be understood that while fluid inserts 20 are illustrated in a preferred form as being disposable, it is also possible, although less desirable, to use reusable, resealable fluid-containing inserts of generally the same size and shape and fluid-holding capacity.

In a further alternate embodiment of the invention shown in FIG. 6A, fluid inserts 20 contain not only a specified amount of storage fluid, but also a disposable contact lens 20*f* of commercially available type. Because fluid inserts 20 are already shaped to conform with the interior dimensions of the lens cups, they are perfectly adapted to carry the lenses themselves.

Once fluid inserts 20 are inserted in cups 14, and secured therein by caps 16, they can be transported indefinitely without risk of leakage or evaporation. They also remain sanitary for the hermetically-sealed shelf life of the lens fluid contained therein. The rigid lens case and cup construction protects the relatively thin-walled fluid inserts from being crushed or punctured.

It will be understood by those skilled in the art that the slots 18 in the bottom surface of cups 14 also help to prevent fluid inserts 20 from sticking to the bottom surface of the cups by capillary suction or otherwise.

In a further form, fluid inserts 20 are transparent so that the user may readily ascertain the appearance and condition of the fluid inside without having to open them.

Referring next to FIGS. 7–11, a preferred form of the key chain attachment device of the present invention is illustrated at 30, comprising in a preferred form a single piece of springy, resilient metal wire of known type. Key ring attachment device 30 generally comprises a closed loop 30*a* which can be securely attached to a key ring or key chain or other objects likely to be carried about a person's body and which would generally accept device 30 in the manner of a key ring or key chain; spaced spring arms 30*b* with a somewhat U- or horseshoe-shape, and spring arm detent ends 30*c*. Ends 30*c* of spring arms 30*b* are spaced in their relaxed position by a distance slightly less than the side to side width of the rounded end 12*a* of lens case 10, and are adapted to horizontally slide into locking groove 12*c* in web 12.

While the illustrated example of attachment device 30 is of a preferred construction, size and shape, it will be understood that the device as a whole or various portions such as the closed loop 30*a* can vary in these parameters.

Figure 8:
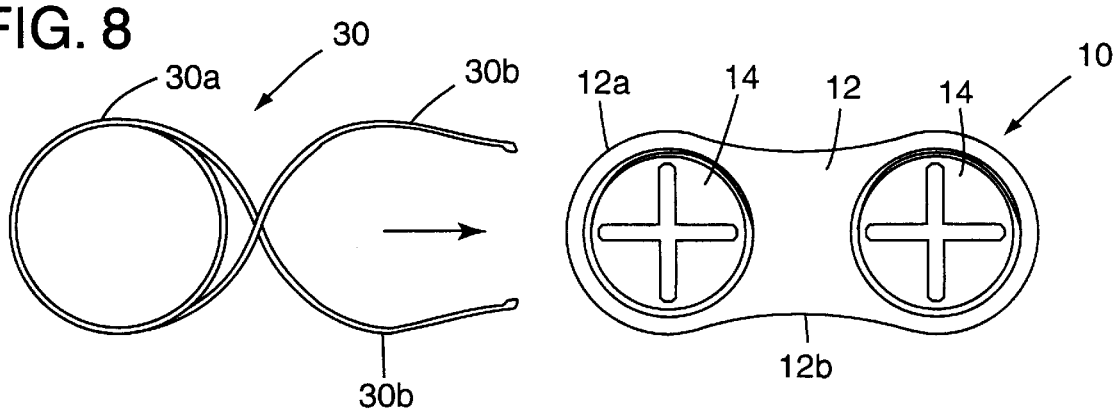
FIG. 8 is an exploded plan view of the lens case of FIG. 1 and the key ring attachment device of FIG. 7, prior to being assembled.
Figure 9:
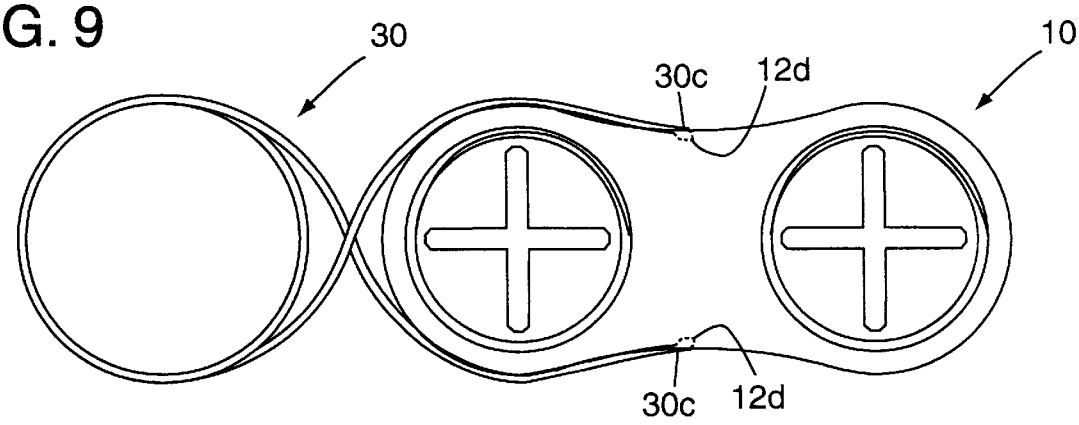
FIG. 9 is a plan view of the lens case and key ring attachment of FIG. 8, assembled.
Figure 10:
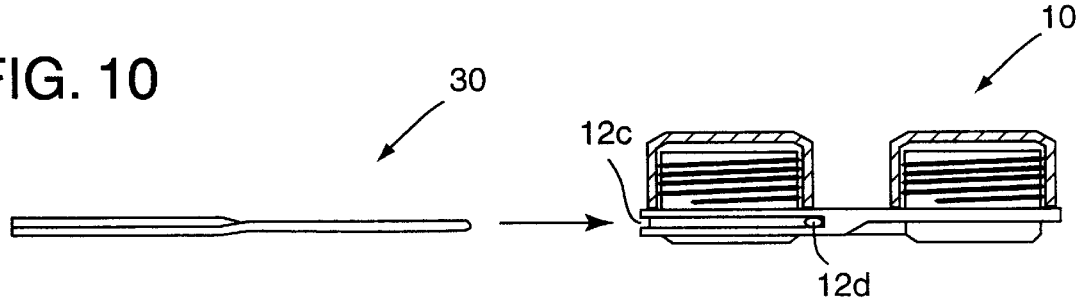
FIG. 10 is a side elevational view of the separated lens case and key ring attachment of FIG. 8.
Figure 11:
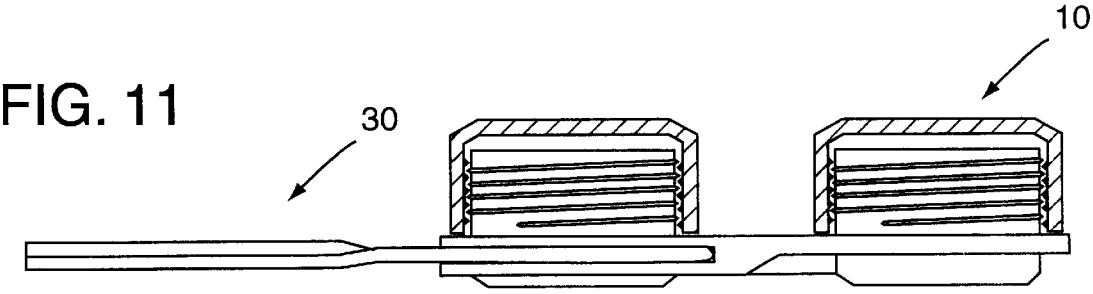
FIG. 11 is a side elevational view of the mated lens case and key ring attachment shown in FIG. 9.

Referring to FIG. 8, the plane of the fork-like spring arms of the attachment device 30 is aligned with the plane of web 12 and then the arms are forced over rounded end 12*a* into locking groove 12*c* in a resilient spring fit wherein they are first slightly forced apart at the widest diameter portion of rounded end 12*a*, and then draw back together as they proceed toward detent holes 12*d* in the ends of locking groove 12*c* located at the narrower middle region 12*b* of web 12. The resilient spring strength of locking arms 30*b* is preferably sufficient to create a strong friction fit with rounded end 12*a* of the lens case, such that a conscious effort is required to separate them. However, the locking connection between attachment device 30 and web 12 can be further enhanced by detents 30*c* on the ends of spring arms 30*b*, which snap into detent holes 12*d* in the ends of locking groove 12*c*. Depending on the depth of the detents and the strength of the spring arms, the attachment device can be configured to pull apart with sufficient force, or can be configured to first require spring arms 30*a* to be spread apart, for example by a squeezing or prying force, before they can be separated from the lens case.

It will be apparent to those skilled in the art, and to contact lens wearers, that lens case 12 using the inventive key chain attachment device 30 according to the invention can quickly and easily be detached from the key chain so that it can be rested on a narrow, flat surface such as the edge of a sink or bathroom counter. In this manner there is no need to fumble with a case attached to a set of keys while removing the fluid inserts or inserting contact lenses. Where counterspace is sufficient, the planar nature of attachment device 30 and its alignment with web 12 may allow case 10 to rest in level fashion on a flat surface, even with a key chain attached.

Figure 12:
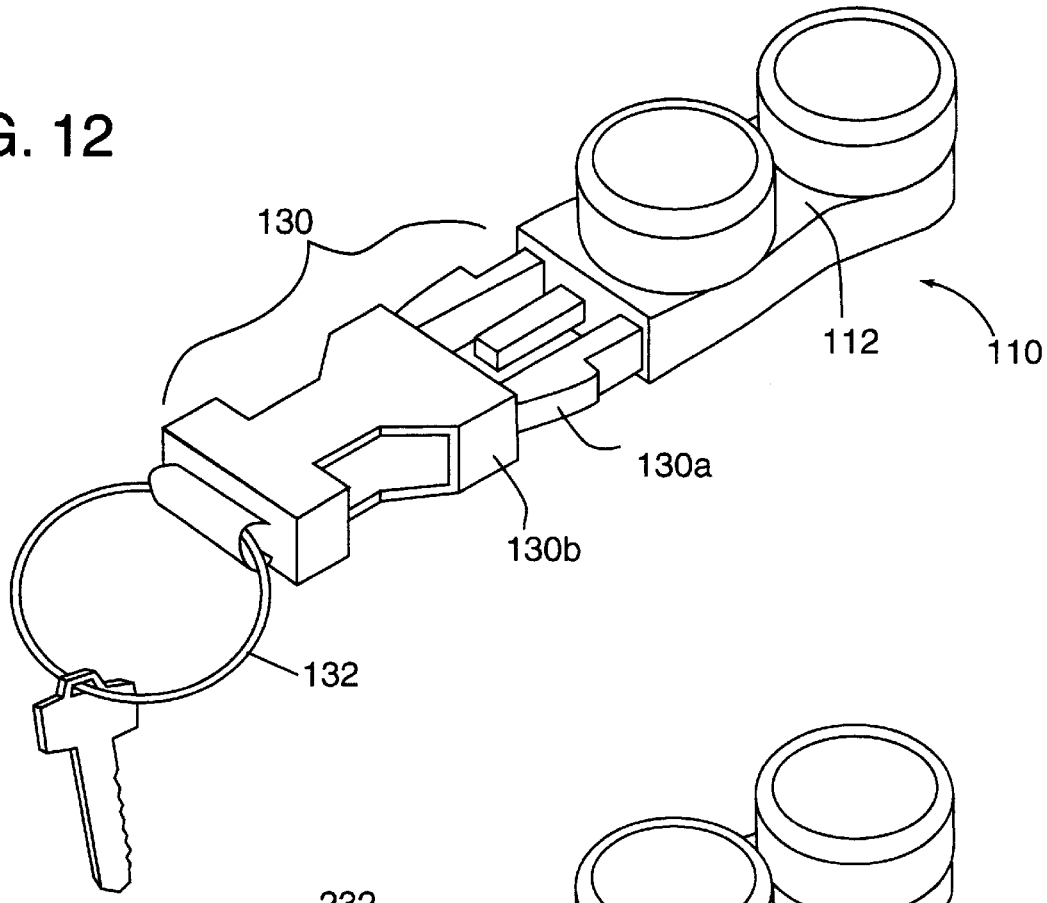
FIG. 12 is a perspective view of an alternate key attachment mechanism for a lens case according to the present invention.
Figure 13:
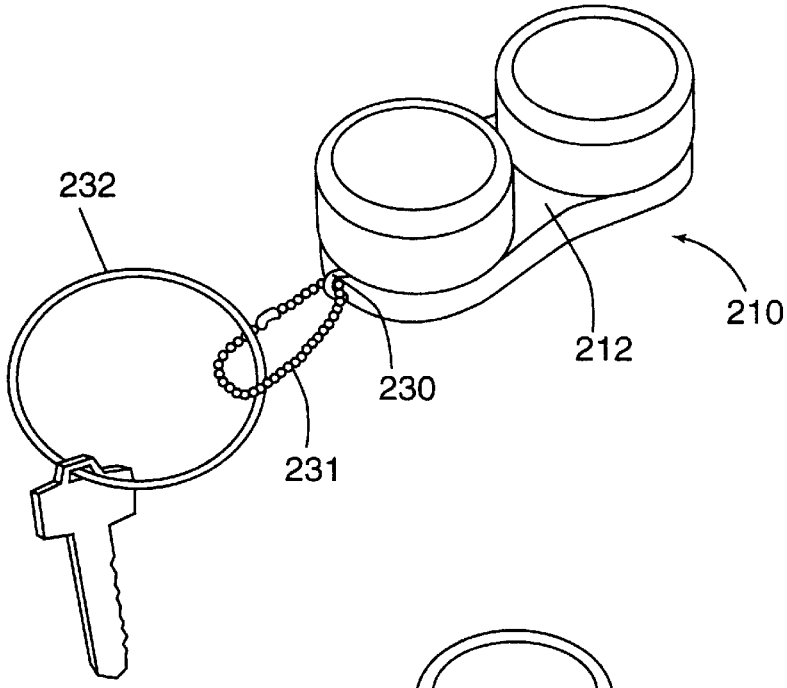
FIG. 13 is a perspective view of a second alternate embodiment of a key attachment mechanism for lens case according to the present invention; and, FIG. 14 is a third alternate embodiment of a key attachment mechanism for a lens case according to the present invention.
Figure 14:
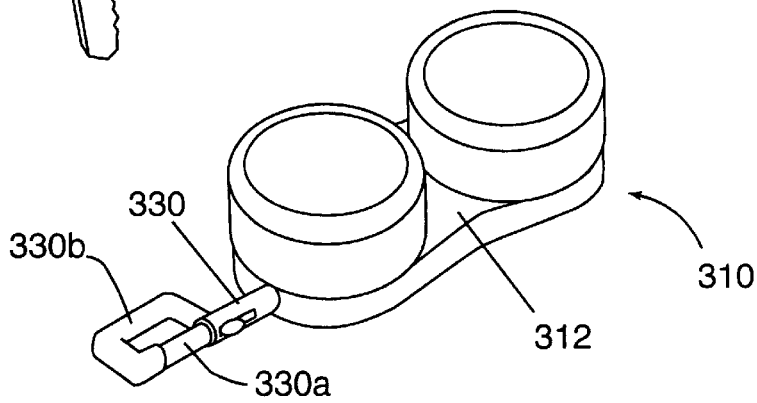

Referring to FIGS. 12–14, three alternate embodiments of the key chain attachment mechanism are illustrated using attachment structure which is known in the art. FIG. 12 illustrates an alternate lens case 110 with a resilient finger buckle mechanism 130 of a generally known type, for example a Fastex® brand fastener, incorporated or connected to the lens case and then in turn connected to a key chain or key ring. In the illustrated embodiment of FIG. 12, the male portion 130*a* of the resilient finger connector is made from plastic, and is either integrally formed with the lens case or secured thereto. The female portion 130*b* of the connector is attached to a key ring 132.

Referring to FIG. 13, a second alternate key chain attachment mechanism is illustrated as a simple, bead-type key chain 231 which is well known in the art, secured to one end of the lens case 231 by an eyelet 230 through which the chain is threaded and then closed. A standard key ring 232 is shown attached to the bead-type chain 231, and can be released therefrom in known manner. Referring to FIG. 14, a third alternate attachment mechanism of known type is illustrated, comprising a known type of generally D-shaped hook 330 with a spring-loaded, thumb-operated plunger 330*a* which can be temporarily depressed to place a key, key ring or key chain into the hook portion 330*b*, and which then locks closed when released. Again, this key chain attachment device can be integrally formed with the lens case 310, for example being made from plastic or metal, or can be secured to the lens case in either permanent or removable fashion.

It will be understood by those skilled in the art that the foregoing illustrated embodiments of my invention are described and illustrated in a preferred form for purposes of explanation, and are not intended to be limiting examples, as the fluid inserts and key ring attachment structure are susceptible of modification without departing from the scope of my invention as described in the following claims.

Accordingly, I claim:

1. A combination contact lens case and contact lens fluid storage system, comprising:

a contact lens case having at least one contact lens cup with a cup-shaped interior adapted for storing or transporting a contact lens therein, the cup further having a removable cap or cover; and, a removable, self-contained, sealed fluid insert sized and shaped to fit inside the cup-shaped interior, the fluid insert being filled with enough contact lens fluid to fill the contact lens case cup to a desired level when the fluid insert is removed from the contact lens case cup.

2. The system of claim 1, wherein the fluid insert is sized and shaped to conform substantially exactly to the cup-shaped interior such that the contact lens case cap or cover can be closed on the contact lens case cup with the fluid insert therein.

3. The system of claim 1, wherein the sealed fluid insert contains a contact lens.

4. The system of claim 1, wherein the cup-shaped interior of the contact lens cup is substantially cylindrical.

5. The system of claim 4, wherein the fluid insert is substantially cylindrical.

6. A combination contact lens case and contact lens fluid storage system, comprising:

a contact lens case having at least one contact lens cup with an interior adapted for storing or transporting a contact lens therein, the cup further having a removable cap or cover; and a removable, self-contained, sealed fluid insert sized and shaped to fit inside the interior of the contact lens cup, the fluid insert being filled with enough contact lens fluid to fill the contact lens case cup to a desired level when the fluid insert is removed from the contact lens case cup.

7. The system of claim 6, wherein the volume of fluid in the fluid insert is the same as the volume needed to fill the contact lens case cup to the desired level.

8. The system of claim 6, wherein the sealed fluid insert contains a contact lens.

9. The system of claim 6, wherein the interior of the contact lens clip is substantially cylindrical.

10. The system of claim 9, wherein the fluid insert is substantially cylindrical.

* * * * *

UNITED STATES PATENT AND TRADEMARK OFFICE

CERTIFICATE OF CORRECTION

PATENT NO. : 6,244,430 B1
DATED : June 12 2001
INVENTOR(S) : Travis

It is certified that error appears in the above-identified patent and that said Letters Patent is hereby corrected as shown below:

Column 5,
Line 46, delete "231" and insert -- 210 --.

Column 6,
Line 52, delete "clip" and insert -- cup --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*